US005611730A

United States Patent [19]

Weiss

[11] Patent Number: 5,611,730

[45] Date of Patent: Mar. 18, 1997

[54] PROGRESSIVE GAMING SYSTEM TAILORED FOR USE IN MULTIPLE REMOTE SITES: APPARATUS AND METHOD

[75] Inventor: Steven A. Weiss, Las Vegas, Nev.

[73] Assignee: Casino Data Systems, Las Vegas, Nev.

[21] Appl. No.: 428,920

[22] Filed: Apr. 25, 1995

[51] Int. Cl.[6] ..... A63B 71/06

[52] U.S. Cl. ..... 463/20; 463/26; 463/29; 463/40; 463/27

[58] Field of Search ..... 273/138 A, 138 R, 273/139, 143 R, 433–436, DIG. 28, 85 CP, 439; 364/410, 412; 340/825.44, 56–58; 463/1, 24, 25, 26–31, 40–42; 455/127, 73, 91, 39

[56] References Cited

U.S. PATENT DOCUMENTS

| | | | |
|---|---|---|---|
| 4,254,404 | 3/1981 | White | 273/138 A |
| 4,335,809 | 6/1982 | Wain | 273/138 A |
| 4,339,798 | 7/1982 | Hedges et al. | 364/412 |
| 4,438,433 | 3/1984 | Smoot et al. | 340/825.44 |
| 4,531,187 | 7/1985 | Uhland | 273/85 CP |
| 4,575,622 | 3/1986 | Pellegrini | 273/DIG. 28 |
| 4,636,951 | 1/1987 | Harlick | 364/412 |
| 4,837,728 | 6/1989 | Barrie et al. | 364/412 |
| 5,038,022 | 8/1991 | Lucero | 364/410 |
| 5,069,453 | 12/1991 | Koza et al. | 273/439 |
| 5,113,990 | 5/1992 | Gabrius et al. | 364/412 |
| 5,116,055 | 5/1992 | Tracy | 273/138 A |
| 5,119,295 | 6/1992 | Kapur | 364/412 |
| 5,129,652 | 6/1992 | Wilkinson | 273/138 R |
| 5,179,517 | 1/1993 | Sarbin et al. | 364/410 |
| 5,197,094 | 3/1993 | Tillery et al. | 364/410 |
| 5,236,199 | 8/1993 | Thompson, Jr. | 273/439 |
| 5,249,800 | 10/1993 | Hilgendorf et al. | 273/138 A |
| 5,257,179 | 10/1993 | DeMar | 273/143 R |
| 5,311,570 | 5/1994 | Grimes et al. | 340/825.44 |
| 5,321,241 | 6/1994 | Craine | 273/138 A |
| 5,324,035 | 6/1994 | Morris et al. | 273/138 A |
| 5,326,104 | 7/1994 | Pease et al. | 273/85 CP |
| 5,344,144 | 9/1994 | Canon | 273/143 R |
| 5,429,361 | 7/1995 | Raven et al. | 273/138 A |
| 5,430,440 | 7/1995 | Shim | 340/825.44 |
| 5,461,664 | 10/1995 | Cappadona | 379/37 |
| 5,470,079 | 11/1995 | LeStrange et al. | 273/138 A |

FOREIGN PATENT DOCUMENTS

| | | | |
|---|---|---|---|
| 0534718 | 3/1993 | European Pat. Off. | G07F 17/32 |

*Primary Examiner*—Jessica Harrison
*Assistant Examiner*—Mark A. Sager
*Attorney, Agent, or Firm*—Bernhard Kreten

[57] ABSTRACT

A progressive gaming system (10) which enables slot machines (100) at a variety of independent non-restricted gaming locations (casino sites) (80) to contribute to and compete for a set of common jackpots. The system (10) provides a secure and reliable real-time progressive system that is capable of operating on a variety of different manufacturers' makes and models of slot machines (100). A tightly controlled computer network (22) at a host site (20) oversees the entire system (10) and is the master for computing all jackpots. All participating casino sites (80) report to, and receive information from, the host site (20) exclusively. A casino site master controller (82) at each casino site is responsible for, inter alia, all data communication between the casino hardware and software and the host site (20). In addition, each "bank" (a group of attached gaming machines) at a casino site (80) has a bank controller (120) and progressive meter display (104). In general, the bank controller (120) is responsible for polling data from the individual attached slot machines (100), storing and validating that data, and exchanging data with the casino site master controller (82). Each attached slot machine (100) further includes a slot machine microcontroller assembly (140), an interface assembly (142), a power supply unit (144) and an electronic circuit (160) which provides a "soft tilt" or "soft lockout" function. Furthermore, a slot machine maintenance system (300) provides wireless communication to technicians correlative of the maintenance required by slot machines (100).

31 Claims, 5 Drawing Sheets

PROGRESSIVE GAMING SYSTEM TAILORED FOR USE IN MULTIPLE REMOTE SITES: APPARATUS AND METHOD

FIELD OF THE INVENTION

This invention relates generally to gaming systems and, in particular, to a progressive gaming system tailored for use in multiple remote sites.

BACKGROUND OF THE INVENTION

The interconnection of a plurality of gaming machines to form a progressive system with a progressive jackpot are in use today. There are various ways in which the progressive jackpot may be determined. One way, for example, is to use a percentage of game play on each of the interconnected machines in order to determine the progressive jackpot. Consequently, the jackpot value progresses until a win transpires at one of the interconnected gaming machines. When a win occurs, the monetary value of the progressive jackpot is paid to the winning party. After the win, the system resets to a base jackpot value. This course of action then repeats as jackpots are won and game play continues.

A progressive controller links the gaming machines to form the progressive system and provides the means to accomplish, among other things, the course of action delineated above. In addition, electronic translators have been interposed between gaming machines and the progressive controller in order to interconnect machines with different denominations, coin-in, hit frequencies, and other differing play characteristics.

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| U.S. PATENT DOCUMENTS | | |
|---|---|---|
| U.S. Pat. No. | ISSUE DATE | INVENTOR |
| 4,837,728 | June 6, 1989 | Barrie, et al. |
| 5,116,055 | May 26, 1992 | Tracy |
| 5,249,800 | October 5, 1993 | Hilgendorf, et al. |
| FOREIGN PATENT DOCUMENTS | | |
| PATENT NO. | ISSUE DATE | INVENTOR |
| EP 0 534 718 A2 | March 31, 1993 | Bally Manufacturing Corp. |

U.S. Pat. No. 4,837,728 to Barrie, et al. teaches the use of a typical progressive system utilized with gaming machines. Barrie, et al. provides a progressive controller for a single bank (or cluster) of slot machines at a single site.

U.S. Pat. No. 5,116,055 to Tracy teaches the use of a progressive system in which an electronic translator is used in addition to a progressive controller. The translator links machines with different play characteristics to the progressive controller. The dollars contributed to the progressive jackpot for a machine per win on that machine is approximately equal for the different machines.

U.S. Pat. No. 5,249,800 to Hilgendorf, et al. teaches the use of a progressive controller and communication unit. The communication unit is used to control the information transmitted between a group of gaming machines and the progressive controller. The communication unit collects coin-in information from each of the gaming machines and transmits this information to the progressive controller in response to periodic signals from the progressive controller.

European Patent No. 0 534 718 A2 teaches the use of an information and communication system for use with a plurality of gaming machines. The system includes a data processor and a plurality of interface units each associated with a corresponding one of the gaming machines. A plurality of control units each associated with a corresponding one of the interface units so as to provide for transfer of information to the processor from the gaming machines and from the processor to the gaming machines.

SUMMARY OF THE INVENTION

The instant invention is distinguished over the known prior art in a multiplicity of ways. One of the starkest differentiations that the instant invention enjoys over the known prior art involves the fact that the instant invention is a progressive gaming system which provides a slot information system that enables, for example, slot machines at a variety of independent non-restricted gaming locations to contribute to and compete for a set of common jackpots by providing real time updates.

More specifically, a host site will be maintained for the overall operation and control of the system. The host site includes a file server/polling computer or host computer, one high-speed modem for each individual casino site, and a networked accounting workstation. The host computer has an attached printer for a real-time audit log of all system events. The networked accounting workstation is provided with a high-resolution printer for printing reports.

Dedicated telephone lines will link the host site to each of the individual casino sites. Dial-up, non-dedicated lines are used for temporary communications as a backup.

Each casino site includes a master controller and a high-speed modem. The casino site master controller has an attached printer for a real-time log of all local audit events as well as some pertinent system wide events.

Each casino site has at least one cluster or bank of slot machines. Each bank of attached slot machines at the casino site has a bank controller and progressive meter display. Each attached slot machine further includes a slot machine microcontroller assembly, slot machine interface assembly, and a power supply unit, all of which are preferably housed in a solid metal, locked security enclosure. Also, each attached slot machine has a wiring harness to provide data signals to the interface assembly. The wiring harness includes a relay circuit necessary for a "soft tilt" feature described infra.

Preferably, the slot machine microcontroller assembly monitors all coins in, coins out, jackpots, slot door access, logic door access, security enclosure access, slot machine reset, maintenance codes and tilt conditions, which include any of the tilt conditions listed in the Nevada State Gaming Regulations Standards 1.070(2). The slot machine microcontroller assembly is also responsible for operating the soft tilt relay circuit. Furthermore, the slot machine microcontroller can provide bill validator information, debit/credit and cashless capabilities. Every event monitored by the system is precisely date and time stamped for reconciliation.

The slot machine microcontroller assembly also includes a key pad interface for interfacing with a keypad. The interface is programmed to include security access to game parameters, maintenance functions, and jackpot and bill transactions.

A slot machine maintenance system interfaces with each slot machine microcontroller assembly and receives status signals therefrom correlative of the maintenance required by the respective slot machine. The maintenance system in turn transmits the status signals to a floor technician using a wireless communication means such as a pager system.

The host computer at the host site is responsible for calculating the progressive jackpot amount, reconciling any system events, and then broadcasting the current progressive jackpot levels to each of the casino site master controllers. The casino site master controller then broadcasts the updated information throughout the casino where it is displayed on the progressive meter displays.

The casino site master controller has certain fail-safes programmed into it for verifying the new jackpot data. These fail-safes include data encryption and password protection, as well as formulas for validating jackpot integrity. If the progressive jackpot amount is questioned, a system event is generated and the host site does a comprehensive audit by polling all casino sites and then recomputes the jackpot amounts. After the comprehensive audit computations, the new amount will govern. The host computer computes the jackpot contribution amount from each casino site on a machine-by-machine basis.

All date and time issues will be reconciled by the host computer's software program. Each casino site and piece of attached hardware (i.e. bank controllers and in-machine controllers) will be synchronized to within approximately 0.1 seconds of the host computer's clock. In the event of a progressive jackpot, all systems should be notified of the jackpot reset within 1 second.

The system is capable of either switching between daylight savings time and standard time, or running continuously on standard time.

OBJECTS OF THE INVENTION

Accordingly, a primary object of the present invention is to provide a new and novel slot information system that enables slot machines at a variety of independent non-restricted gaming locations to contribute to and compete for a set of common jackpots.

A further object of the present invention is to provide a device as characterized above which is a secure and reliable real-time progressive system that is capable of operating on a variety of different manufacturer's makes and models of slot machines.

Another further object of the present invention is to provide a host site including a file server/polling computer or host computer, a high speed modem for each individual casino site, and a networked accounting workstation.

Another further object of the present invention is to operatively couple a printer to the host computer for a real-time audit log of all system events.

Another further object of the present invention is to operatively couple a high-resolution printer to the networked accounting workstation for printing reports.

Another further object of the present invention is to provide dedicated telephone lines linking the host site to each individual casino site.

Another further object of the present invention is to provide dial-up, non-dedicated telephone lines as backup temporary communication links.

Another further object of the present invention is to provide a casino site master controller and a high speed modem at each individual casino site.

Another further object of the present invention is to provide a bank controller and progressive meter display for each bank of attached slot machines at a casino site.

Another further object of the present invention is to provide each attached slot machine with a slot machine microcontroller assembly, a slot machine interface assembly and a power supply unit, all of which will be housed in a solid metal locked security enclosure.

Another further object of the present invention is to further provide each attached slot machine with a wiring harness to connect data signals to the interface assembly, which will include a relay circuit necessary for a "soft tilt" feature.

Another further object of the present invention is to provide means to monitor all coins in, jackpots, slot door access, logic door access, security enclosure access, slot machine reset and tilt conditions.

Another further object of the present invention is to program into the casino site master controller certain fail-safes for verifying the new jackpot data which includes data encryption and password protection, as well as formulas for validating jackpot integrity.

Another further object of the present invention is to have the host computer do a comprehensive audit by polling all casino sites and then recompute the jackpot amounts if the progressive jackpot amount is questioned; after the comprehensive audit computations are completed, the new amount will govern.

Another further object of the present invention is to have the host computer compute the jackpot contribution amount from each casino site on a machine-by-machine basis.

Another further object of the present invention is to have every event monitored by the system precisely dated and time stamped for reconciliation.

Another further object of the present invention is to have all of the date and time issues reconciled by the host computer program.

Another further object of the present invention is to have each casino site and piece of attached hardware (i.e., bank controllers and in-machine controllers) to be synchronized to within approximately one tenth of a second of the host computer's clock.

Another further object of the present invention is that, when the event of a progressive jackpot has occurred, all systems are notified of a jackpot reset within one second.

Another further object of the present invention is the ability of switching between daylight savings time and standard time, or running continuously on standard time.

Viewed from a first vantage point, it is an object of the present invention to provide a progressive gaming system comprising in combination: a host site including a host computer; a plurality of gaming sites each including a plurality of gaming machines; means for acquiring gaming machine generated signals including a funds-in signal and maintenance signals from each gaming machine at each gaming site; means for exchanging data including gaming machine generated signals between acquiring means and the host computer whereby the plurality of gaming machines contribute to and compete for at least one progressive jackpot.

Viewed from a second vantage point, it is an object of the present invention to provide a progressive gaming system comprising in combination: an array of gaming devices; means for monitoring maintenance signals of the gaming devices; means for receiving the maintenance signals from the monitoring means; at least one portable pager; the pager carried by a human, and wireless communication means for relaying message signals correlative of the maintenance signals from the receiving means to at least one portable pager.

Viewed from a third vantage point, it is an object of the present invention to provide a method for providing a progressive gaming system, comprising the steps of: providing a host computer at a host site; providing at least two remote gaming sites; providing a plurality of gaming machines at each remote gaming site; providing at least one bank controller at each of the remote gaming sites; interfacing a microcontroller assembly to each gaming machine at each remote site; connecting a plurality of the microcontroller assemblies to at least one bank controller; acquisitioning data including maintenance data from each gaming machine on its activity by the microcontroller assembly; reporting the acquisitioned data from each microcontroller assembly to each respective bank controller; providing a master controller at each remote gaming site; reporting the data from each bank controller at each remote gaming site to each respective master controller; reporting the data from each master controller at each remote gaming site to the host computer at the host site; processing by the host computer all data for computing contribution rates and a progressive jackpot amount, and broadcasting the progressive jackpot amount from the host computer to each master controller.

These and other objects will be made manifest when considering the following detailed specification when taken in conjunction with the appended drawing figures.

DESCRIPTION OF PREFERRED EMBODIMENTS

Figure 1:
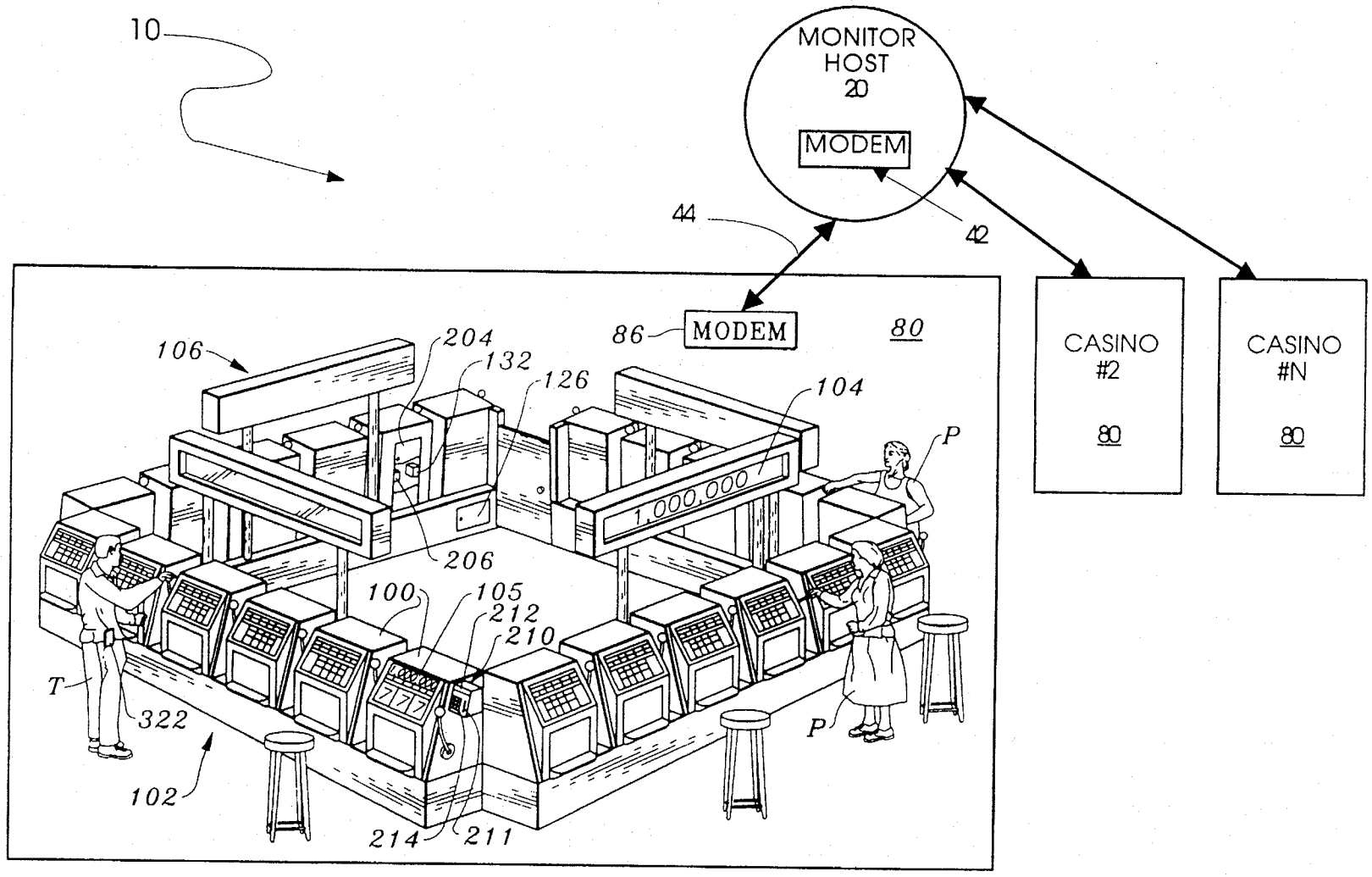
FIG. 1 is a perspective view of a progressive gaming system tailored for use in multiple remote sites in accordance with the principles of the instant invention.

Considering the drawings, wherein like reference numerals denote like parts throughout the various drawing figures, reference numeral 10 is directed to a progressive gaming system tailored for use in multiple remote sites according to the present invention.

In essence, and referring to FIG. 1, the system 10 is a slot information system that enables slot machines 100 at a plurality of independent non-restricted casino sites 80 to contribute to and compete for a set of common jackpots.

Figure 2:
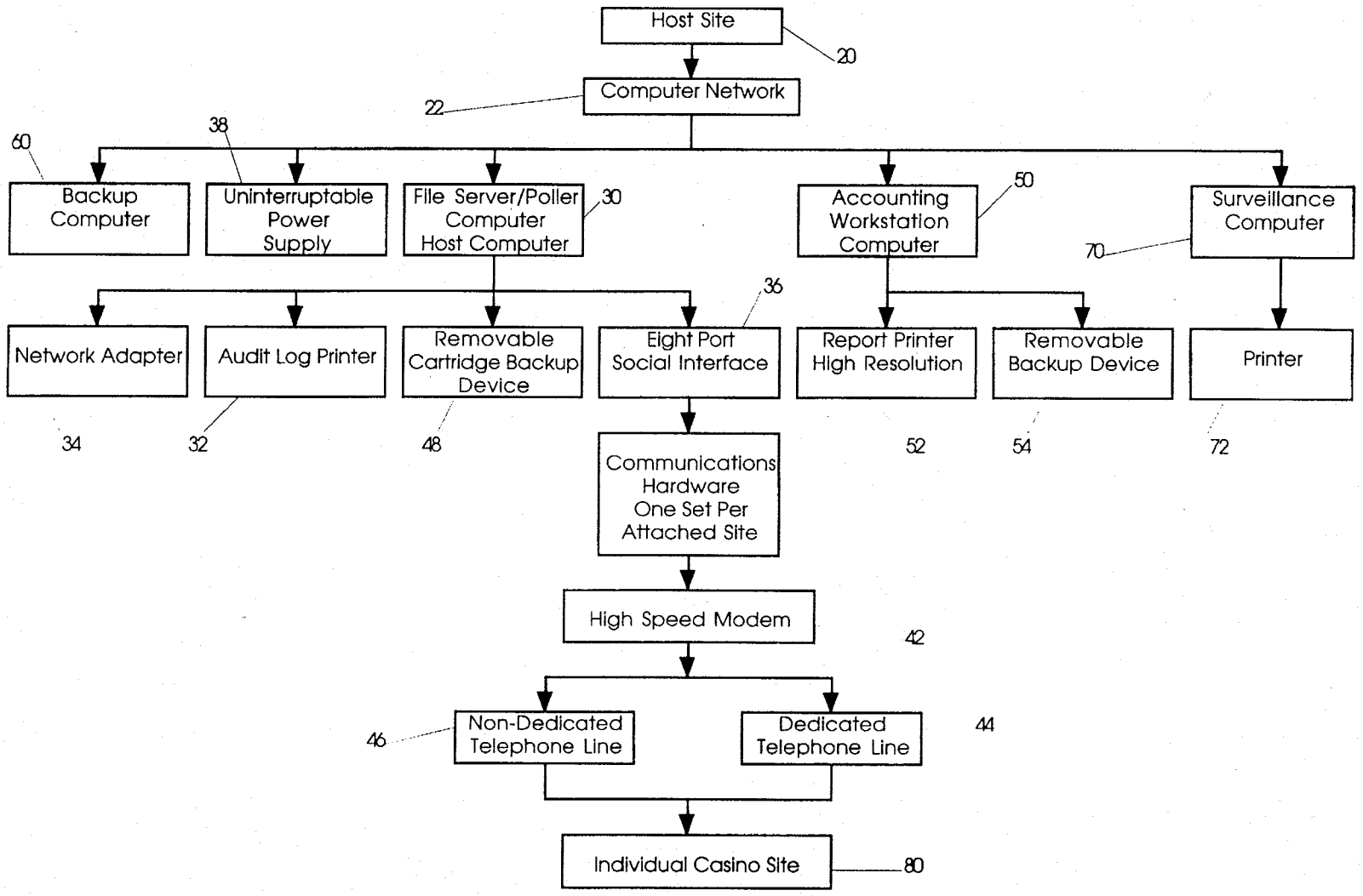
FIG. 2 is a block diagram of the host site topology of the progressive gaming system tailored for use in multiple remote sites.

Referring to FIG. 2, a host site 20 will be maintained for the overall operation and control of the system 10. The host site 20 includes a file server/polling computer or host computer 30 and an accounting workstation computer 50 operatively coupled together by a computer network 22. The file server/polling computer 30 is provided with a high-speed modem 42 for each individual casino site 80.

Figure 3:
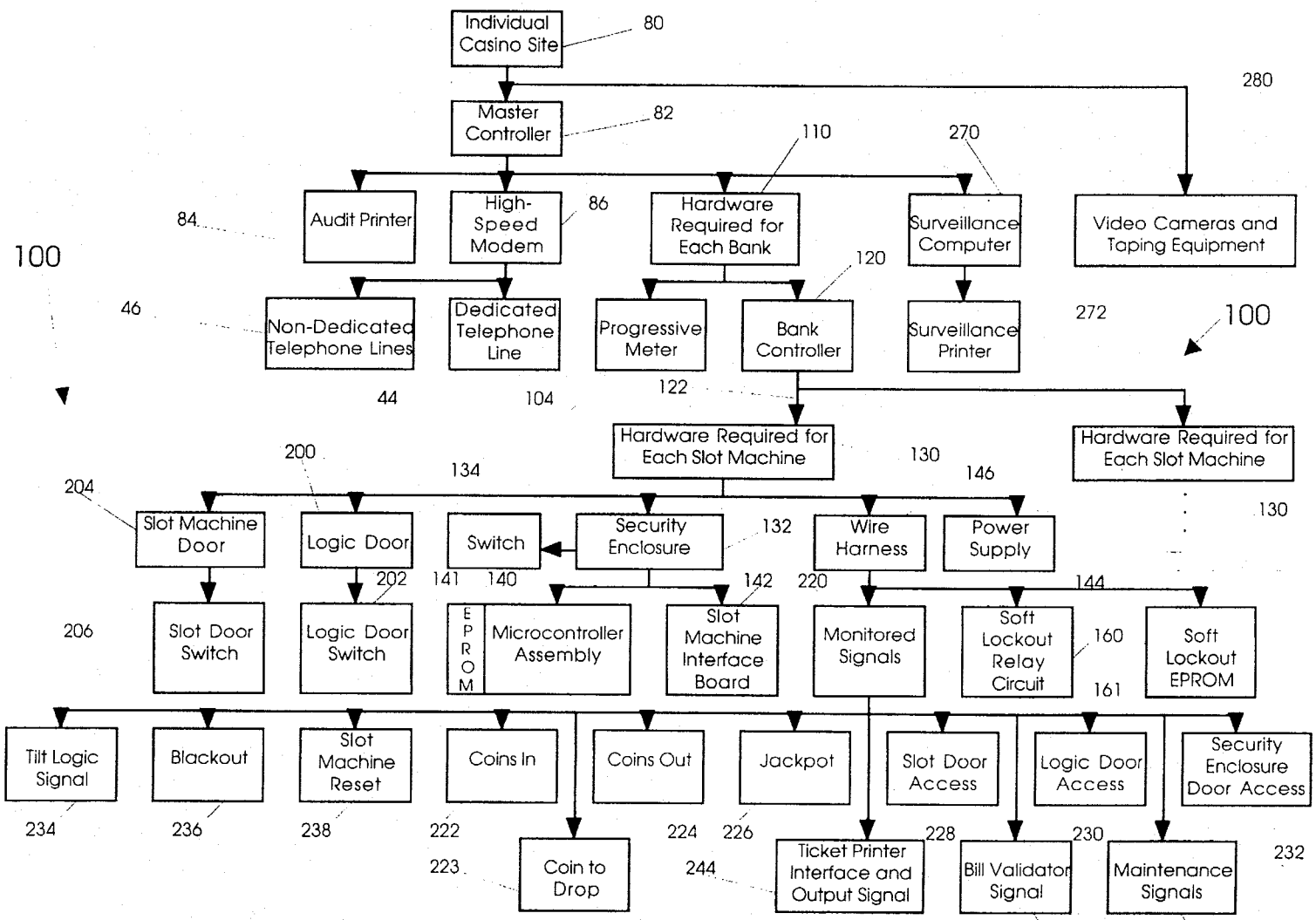
FIG. 3 is a block diagram of the casino site topology of the progressive gaming system tailored for use in multiple remote sites.

Referring to FIG. 3, each casino site 80 includes a casino site master controller 82 provided with a high-speed modem 86 operatively coupled thereto. Bi-directional communication between the file server/polling computer 30 at the host site 20 and each casino site master controller 82 is accomplished by the set of modems 42, 86 transferring data over dedicated telephone communication lines 44.

A bank controller 120 and a progressive meter display 104 are operatively coupled to each master controller 82 and to each bank 102 of attached slot machines 100 at each casino site 80. Each individually attached slot machine 100 includes a slot machine microcontroller assembly 140, a slot machine interface assembly 142 and a power supply unit 144. In addition, each attached slot machine 100 includes, for example, a wiring harness 146 to connect data signals from the slot machine 100 to the interface assembly 142. The wiring harness 146 further includes a relay circuit 160 providing a "soft tilt" or "lockout" feature.

Host Site

More specifically, and referring to FIG. 2, the host site 20 is responsible for overseeing the entire progressive gaming system 10. All casino sites 80 exclusively report to and receive information from the host site 20. It is the master for computing all jackpots and provides the highest level of security and data assurance.

All access permissions to the system 10 will be regulated according to individual user access rights. Passwords will be required for logging on to the system 10 and for accessing certain highly-secure functions. The system 10 should require passwords to be updated periodically, for example quarterly. The host site 20 includes the following hardware:

Computer Network

The computer network 22 at the host site 20 is a tightly controlled local area network (LAN) 22. Preferably, only two computers will have read/write access to, or be connected in any way to the host site LAN 22: the file server/polling computer 30 and the accounting workstation computer 50. Preferably, a surveillance computer system 70 will provide visual monitoring of the host site 20 and be operatively coupled to the network 22 with read-only access.

The LAN 22 accomplishes the following goals. First, the LAN 22 allows authorized users to produce accounting and auditing reports without disrupting the normal operation of the system 10. Second, the LAN 22 restricts access to the main file server/polling computer 30 by any user so that any data access may be strictly limited and accounted for.

File Server/Polling Computer

The file server/polling computer or host computer 30 is preferably a mini-main frame, for example, a Compaq 486 DX/66 computer which runs under a DOS operating system. Its hardware has incorporated into it a number of safety and data reliability features including, but not limited to, boot control or lockout and a mirrored fault tolerant disk system. This means that access to the host computer is restricted and that there is a redundancy in the storage of data. Preferably, additional hardware in the computer 30 will include a network adapter 34 such as is vended by LANtastic, model number AE-2 and one eight-port serial communications board 36 for every eight participating casino sites 80. A printer 32 is operatively coupled to the file server/polling computer 30 in order to provide a real-time audit log of all system events.

The primary functions of the file server/polling computer 30 are: to communicate with all casino sites 80 by uploading and downloading data and recording all events on its disk drive and the audit printer 32; to process data for computing the progressive meter values and download these values to update the casino sites 80 accordingly; and to process data for computing all contribution amounts from each casino site 80 on a machine-by-machine 100 basis.

This computer 30 will be housed in a secure environment and attached to an uninterruptable power supply (UPS) 38. Access to the host site 20 computer room will be restricted.

Accounting Workstation Computer

The accounting workstation computer 50 is preferably a 486DX computer running at 33 MHz or greater which provides the only update access path for users to the progressive data. The LAN software will prevent users from accessing the primary data directories of the file server/polling computer 30. The accounting workstation computer 50 is responsible for producing the standard accounting, auditing and maintenance reports, as well as various other report inquiries. A second printer 52 is operatively coupled to the accounting workstation computer 50 for printing these reports. Any file maintenance performed on the data base (e.g. slot machine 100 additions or deletions, adding or removing casino sites 80, jackpot file maintenance, etc.) will be accomplished at the accounting workstation computer 50 and logged by the file server/polling computer 30 as audit exceptions.

Surveillance Computer

The surveillance computer system 70 will provide a visual display of real-time transactions on a computer monitor and maintain a printer log, via printer 72, of all events. This computer system 70 is designed to allow necessary real-time access to data without required access to the main file server/polling computer 30. The computer system 70 requires an authorized user to "sign off" on certain transactions before they clear from the screen. This offers another level of security assurance.

High-Speed Modems

Preferably, the high-speed modems 42 are V.32 BIS high-speed asynchronous modems such as manufactured by Hayes. This allows the highest throughput of data across normal voice grade non-dedicated telephone lines 46. All communications data packets will be encrypted and include a password that is automatically updated by the progressive gaming system computers 30 and 50.

Dedicated Communications Lines

Each casino site 80 is provided with dedicated communications lines 44 in addition to the normal non-dedicated telephone lines 46, in order to provide communication links to the host site 20.

Communications Methods

All data communications are accomplished by an exchange of encrypted message packets across the communications lines 44. In the normal case, the lines 44 are dedicated; however, as a backup, the host site 20 utilizes dial-up, nondedicated lines 46 for short term communications to an otherwise off-line casino site 80.

In the event that the file server/polling computer 30 can no longer communicate with a casino site 80 through the dedicated telephone lines 44, it will be able to dial-up the casino site 80 and maintain a dialog over the non-dedicated lines 46 until the dedicated lines 44 are restored.

Each data packet includes date and time information, sequence numbers, checksums, and passwords, to help ensure reliability and security.

Backup Methods

A removable backup device 54, such as a medium capacity cartridge backup, will be an integral part of the host site system 20. Regular backups will be performed from the accounting workstation 50. Backup procedures and the storage and handling of the backup media will be regulated. All history data, current jackpot and machine data, and audit data will be backed up at least daily.

The file server/polling computer 30 is preferably equipped with a removable backup cartridge device 48. This device 48 is utilized by the system 10 as a local hard disk drive on the file server/polling computer 30. It is not networked. All transactional data will be logged to the removable cartridge device 48. Periodically, throughout the day, current jackpot meter and reserve information will be stored on the removable cartridge device 48. Cartridges 48 may be exchanged by authorized users by performing an operation on the file server/polling computer 30. This will be logged in the audit trail.

Cartridges 48 should be rotated weekly and one cartridge 48 each quarter should be designated as a vault copy.

In the event of a system failure of the file server/polling computer 30, the software would be installed on a backup computer 60 along with the files from the cartridge 48. High speed modem 42 would be operatively coupled to the backup computer 60 and then the software would be executed. At that point, the system 10 would be restored to normal-type operations.

Casino Site

Each individual casino site 80 will be a previously approved non-restricted gaming location. The casino site 80 is responsible for all data communication between the casino hardware and software and the host site 20. All casino sites 80 report to and receive information from the host site 20 exclusively. Referring to FIG. 3, each casino site includes the following hardware:

Casino Site Master Controller

The casino site master controller 82 is responsible for all communications between the progressive meter displays 104 and bank controllers 120 at the casino site 80 and the file server/polling computer 30 at the host site 20. It also stores a large number of events in an associated memory and logs all events to an attached printer 84. The attached printer 84 provides a real-time log of all local audit events as well as some pertinent system wide events.

The casino site master controller 82 is further responsible for broadcasting the current progressive amounts to the progressive meter displays 104 and verifying that the correct progressive amount is, in fact, being displayed.

Surveillance Computer

A second surveillance computer 270 offers a display and in conjunction with an attached printer 272, a hard copy of all real-time events at the local casino site 80. This computer 270 is preferably identical to the host site surveillance computer 70.

High-Speed Modem

The high-speed modem 86 will preferably be the same grade of modem utilized by the file server/polling computer 30 at the host site 20.

Bank Hardware

Each bank 102 of slot machines 100 at a casino site 80 (FIG. 1) requires bank-specific hardware 110 including a bank controller 120. A "bank" 102 of slot machines 100 is a general term referring to a group of slot machines 100 connected to a single bank controller 120 preferably by daisy-chained, shielded twisted-pair wire 122. Also, each bank 102 of slot machines 100 preferably will have at least one progressive meter display 104.

Preferably, six LED indicators on the bank controller 120 reflect the current communications mode and an incandescent light for indicating power. In addition, the bank controller supports "flash" download for microcontroller assembly EPROMS.

Bank Controller

The bank controller 120 is a microcontroller designed for polling data from the individual attached slot machines 100, storing and validating that data, and exchanging data with the casino site master controller 82. In addition to storing all of the data with respect to the display of the current progressive meters and their status, the bank controller stores the most recent player transactions in one section of memory and the most recent security and maintenance transactions in another. The memory in the bank controller is preferably capacitor backed up for at least one week. Also, all of the bank controller data is stored on the file server/polling computer 30. The bank controller 120 is mounted in a drop cabinet 126 (FIG. 1) of the first attached slot machine on each bank 102 of slot machines 100.

If any individual slot machine 100 should fail or lose its memory for any reason, the bank controller 120 will immediately attempt to repair the defect by conducting a full hardware and software diagnostic test of the slot machine microcontroller assembly 140 or by downloading all of the individual slot machine's memory back to the slot machine microcontroller assembly 140. If the problem is solved, an exception is generated and operations continue normally; otherwise, the bank controller 120 will attempt to "lock out" the slot machine 100, i.e., remove the slot machine 100 from the progressive pool of slot machines.

The casino site master controller 82 will verify the integrity of the bank controller 120 by periodically checking its EPROM checksum or cyclic redundancy counter, and by periodically comparing random bytes in the EPROM program with known values stored in the data segment of the casino site operating software.

Progressive Meter Displays

Preferably, a tricolor LED system will be used for each of the overhead progressive meter displays 104 which will be housed in interior casino sign 106. However, the system may include means to loop-back progressive data for in-machine progressive meters 105. The overhead displays 104 are available with standard or high resolution pixel patterns. Overhead meters 104 preferably display progressive jackpots with dynamic odometer effects, text messages and player attracting animation. In-machine progressive meters 105 are available in enhanced resolution tri-color models and a single color, alpha-numeric model. This compact meter 105 fits top award Insert areas on many popular games manufactured by the industry's leaders.

Interface Cable

All slot machines 100 communicating on a bank 102 will preferably be connected in parallel to the bank controller 120 via shielded twisted-pair cabling 122. All inter-slot communications will be encoded message packets preferably utilizing an RS-485 two-wire protocol. Only the bank controller 120 is capable of communicating with an individual slot machine 100. Any break in cabling 122 will be reported by the bank controller 120 as an exception event.

Slot Machines

The system 10 is designed to accommodate virtually any Gaming Commission approved electronic slot machine device 100 that supports the complex serial or rapid bonus system protocols. Referring to FIG. 3, each slot machine 100 includes the following hardware:

Security Enclosure

The slot machine microcontroller assembly 140, an interface assembly 142, and a power supply 144 will be housed in a locked sheet metal security enclosure 132 mounted securely inside each individual slot machine 100.

Security Enclosure Switch

A switch 134 is attached to the slot machine security enclosure 132 that allows the slot machine microcontroller assembly 140 to monitor any access to its progressive in-machine electronics.

Slot Machine Microcontroller Assembly

The slot machine microcontroller assembly 140 is a microcontroller specifically designed for data acquisition from slot machines 100. Microcontroller assembly 140 is responsible for the accurate collection and reporting of data from the slot machine 100 and, in the event of a non-recoverable failure or prolonged loss of communications, the soft locking out of the slot machine 100.

The microcontroller assembly 140 is designed to monitor multiple signals from the individual slot machine 100. The signals monitored may include, but are not limited to, standard signals such as Coins In 222, Coins Out 224, Jackpots 226, Slot Door Access 228, Logic Door Access 230, Security Enclosure Access 232, Tilt Logic Signal 234, Blackout 236, Slot Machine Reset 238 and Maintenance codes 240.

The slot machine microcontroller assembly 140 preferably stores transactions in an associated internal RAM for data dependability. This internal memory is maintained in the assembly 140 with power-down conditions and is backed up in the bank controller 120 and host computer 30.

In addition, the microcontroller assembly 140 is "flash capable" for allowing authorized downloadable firmware upgrades of its EPROM 141.

The slot machine microcontroller assembly 140 supports optical and magnetic cardreader units. The assembly 140 in cooperation with a cardreader unit 210 will accept player, mechanic, floorperson, setup and self-diagnostic cards via a card receiver 211. A display 212 may be provided which works in cooperation with the cardreader unit 210. One example of a typical display is a two-line by 16 character LCD with backlighting.

The microcontroller assembly 140 can also interface with the display 212 for displaying attractor messages, total bonus points with every card in, a countdown value during play and earned session points during play. Furthermore, the microcontroller assembly 140 may work in cooperation with the display for displaying the EPROM version of the microcontroller assembly program, the microcontroller assembly identification number, the bank controller 120 identification number, the last two digits of the coin in and coin out meters and current slot door status.

The slot machine microcontroller assembly 140 also includes a keypad interface for interfacing with a keypad 214 of the cardreader unit 210. The interface is programmed to include security access to game parameters, maintenance functions and jackpot and fill transactions. The keyboard interface is capable of cooperating with, for example, a 16 key keypad.

Slot Machine Interface Assembly

The slot machine interface assembly 142 couples the slot machine microcontroller assembly 140 to the slot machine 100. The slot interface assembly 142 may interface with a slot machine 100 through direct wire, pulse signal, synchronous communication, asynchronous RS-232 communication, fiber optics, etc. The interface assembly 142 provides a guarantee that the connection to the slot machine 100 is listen-only and that the progressive in-machine hardware cannot affect the operation of the slot machine 100 in any way. One way of providing this type of connection is, for example, to use a set of optically isolated interfaces. In addition, the interface assembly 142 provides means to process a variety of slot machine signals with varying voltages and current types into clean logic signals.

In-Machine Wiring Harness

Preferably, a set of discrete shielded cables 146 is used to connect certain data points inside the slot machine 100 to the slot machine interface assembly 142. The in-machine harness 146 preferably includes a soft tilt relay circuit 160 that enables the slot machine microcontroller assembly 140 to "soft lockout" the game.

Soft Tilt Relay Circuit

The soft tilt relay circuit 160 is designed to enable the slot machine microcontroller assembly 140 to place the slot machine 100 in a soft tilt or lockout condition. While the slot machine 100 is in this soft tilt condition, the customer will no longer be able to wager cash, coins, or credits; pull the handle; or activate the spin button. The customer will, however, be able to cash out any credits that are on the machine's credit meter. The relay circuit 160 will be described in greater detail hereinafter. Alternatively, the soft tilt could be provided with the cooperation of the machine 100 manufacturer in the form of an soft tilt EPROM 161 that supports a lockout pin on an I/O port of the machine 100.

Logic Door

A logic door 200 is installed by each slot machine manufacturer and is a door and key lock assembly that houses the slot machine's critical electronics (e.g., a motherboard, EPROMs, and any other programmable boards). A key lock assembly may be provided if it is not offered as an option by the manufacturer.

Logic Door Switch

A switch 202 will be attached to the logic door assembly that allows the slot machine microcontroller assembly 140 to monitor any access to the slot machine's critical electronics.

Slot Machine Door Switch

The slot machine microcontroller assembly 140 will monitor any opening or closure of a slot machine door 204 either by interfacing with the existing manufacturer's switch or a separately attached switch 206, depending upon the machine type. The slot machine microcontroller assembly 140 will disregard all coins received while the slot machine door 204 is open and will report coins received while the door 204 is open as an exceptioned event.

Power Supply

The slot machine microcontroller assembly 140 requires a low voltage power supply unit 144 to operate. This unit 144 will be located inside the slot machine 100 and attached to the auxiliary power port of the machine's own power supply. Any interruption in power to the slot machine microcontroller assembly 140 will be logged by the bank controller 120 and reported as an exceptioned event.

Monitored Signals

Preferably, the following slot machine information will be monitored continuously by the slot machine microcontroller assembly 140: coins in 222, coins to drop 223, coins out 224, jackpots 226, slot door access 228, logic door access 230, security enclosure access 232, tilt logic signal 234, blackout 236, slot machine reset 238, maintenance signals and status 240, bill validator signal 242 and ticket printer interface and output signal 244.

Tilts

The progressive gaming system 10 will indicate a tilt if any objectionable condition such as those listed in the Nevada Gaming Regulations Standards Section 1.070(2) occurs. Any machine 100 that is modified or submitted as a new gaming device after September 1989 must tilt on each of these conditions.

On some manufacturers' games, such as the IGT S+ slot machine, the system will identify the specific tilt condition. These may include such events as a coin in tilt, coin out tilt, memory failure, hopper tilt, machine reset, reel tilt, slot door open, slot door close, jackpot, B switch (handle pull), and progressive jackpot.

Soft Tilt

One feature of importance in the system 10 is the soft tilt or soft lockout function. When a slot machine microcontroller assembly 140 can no longer verify the current jackpot amount, it will render the game unplayable yet still allow customers to cash out their credit balances. The soft lockout condition is most probably due to a prolonged loss of communications between either the slot machine microcontroller assembly 140 and the bank controller 120, between the bank controller 120 and the casino site master controller 82, or between the casino site master controller 82 and the file server/polling computer 30.

The soft tilt relay circuit 160 will be installed in the slot machine 100 and allows the slot machine microcontroller assembly 140 to both initiate and implement the soft tilt operation. As mentioned, the slot machine microcontroller assembly 140 is electrically isolated from the game by the slot machine interface assembly 142 and cannot interfere with the normal mode or method of operation of the game.

During the soft tilt condition, the customer may cash out any credits remaining on the credit meter; however, after the completion of any game in progress, the customer will electronically be prevented from making any wager (cash, coin, or credit), or from starting a new game (handle pull or spin button).

A light emitting digital indicator $L_1$ on the relay circuit 160 will allow slot machine maintenance and floor personnel to quickly determine the current mode of the machine 100.

Once the error condition that forced the slot machine 100 into soft tilt mode has been corrected, the system will automatically restore the game to normal operation.

The relay circuit 160 provides that the slot machine microcontroller assembly 140 be functioning properly for the game to be played. If power to the slot machine microcontroller assembly 140 is interrupted, the relay circuit 160 will render the slot machine unplayable.

Soft Tilt Relay Circuit

Figure 4:
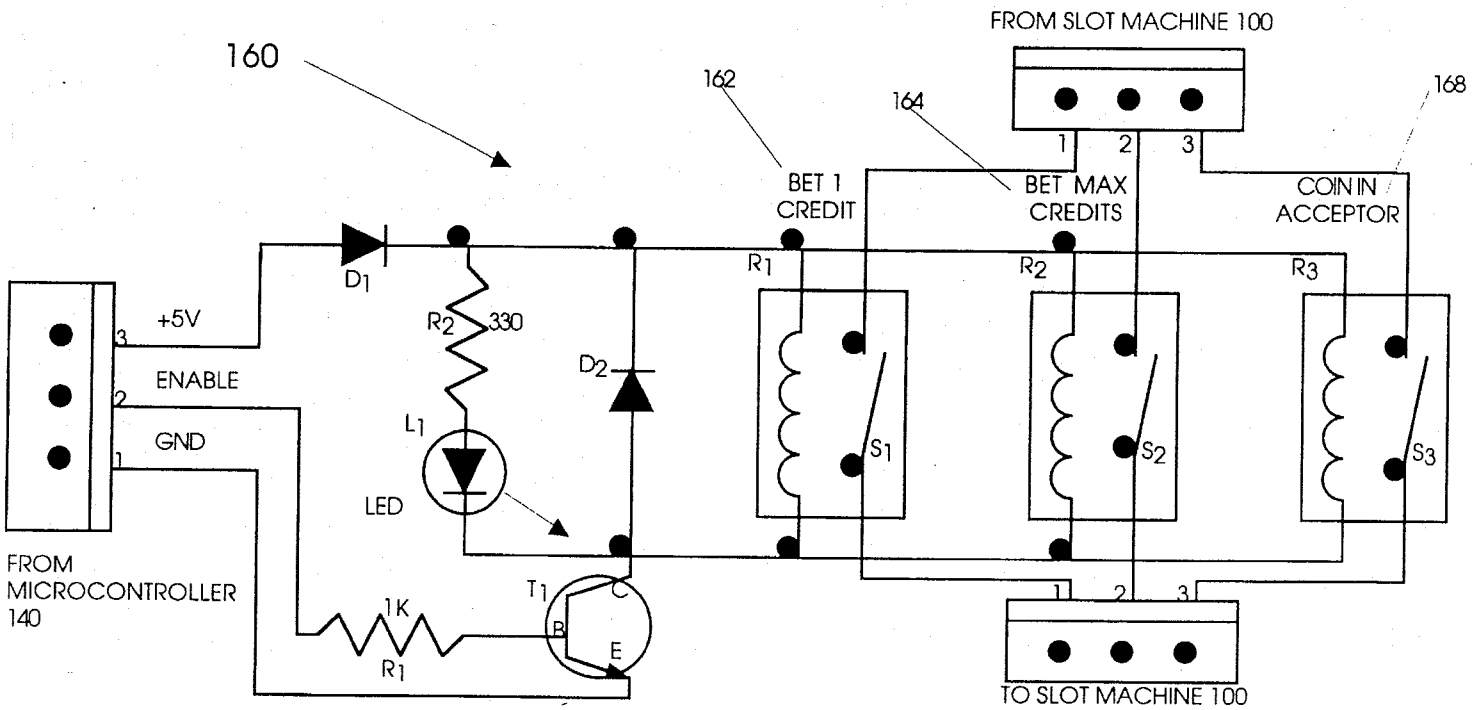
FIG. 4 is a schematic of a soft tilt relay circuit of the progressive gaming system tailored for use in multiple remote sites.

FIG. 4 shows a schematic view of the soft tilt relay circuit 160. The relay circuit 160 is provided with three outputs from the slot machine microcontroller assembly 140: a ground output, an enable output and a five volt potential output. A transistor $T_1$ is used as a switch and when enabled, provides a current path from the five volt potential output through circuit components to ground. The transistor $T_1$ has an emitter E connected to the ground output, a base B connected to the enable output via a resistor R1 and a collector C connected to one common end, a "cold" end, of five parallel branches. The parallel branches have two common ends for electrical connections, a "cold" or negative end and a positive end. The common "cold" end of the five parallel branches is connected to the collector of the transistor while the common positive end of the five parallel branches is connected to the five volt potential output by way of a diode $D_1$.

Diode $D_1$ allows current to pass from the slot machine microcontroller assembly 140 to the relay circuit 160 but blocks current from flowing back into the slot machine microcontroller assembly 140 from the circuit 160. In other words, the anode of the diode $D_1$ is connected to the five volt output of the slot machine microcontroller assembly 140 and the cathode is connected to the positive side of the five parallel branches.

Three of the five parallel branches include relays $RL_1$, $RL_2$ and $RL_3$, the fourth branch includes a diode $D_2$ and the fifth branch includes a series arrangement of a resistor $R_2$ and the light emitting diode $L_1$ ($LED_1$).

When the enable signal is low, there is no bias voltage applied to the base B emitter E junction of the transistor $T_1$, thereby keeping the transistor turned off. When the enable output is high, the transistor $T_1$ is biased on hard thereby conducting current. As mentioned, the cold end of the five parallel branches is connected to the collector C of transistor $T_1$ and when enabled, the transistor $T_1$ provides a current path to ground through four of the five parallel branches. Three of the four parallel branches conducting current are those which include relays $RL_1$, $RL_2$ and $RL_3$. Once these relays $RL_1$, $RL_2$ and $RL_3$ begin to conduct current, their complementary switches $S_1$, $S_2$ and $S_3$ close. The fourth parallel branch conducting includes resistor $R_2$ and LED $L_1$ whereby the resistor $R_2$ is used to limit the flow of current through the LED $L_1$.

The fifth branch, the branch that contains diode $D_2$, is used to de-spike the circuit when the transistor is enabled or disabled. When the coils of relays $RL_1$, $RL_2$ and $RL_3$ are energized, they build up a magnetic field. When the coils are deenergized the field collapses and generates a counter electromotive force EMF voltage. Such voltages can reach very high levels, and can potentially damage the device. In any event, whether or not the voltage spike damages the component it can cause a spurious glitch signal that upsets operation of the circuit 160. When the transistor $T_1$ is enabled, the diode $D_2$ is reverse biased, but when the transistor $T_1$ is disabled, the coils of relays $RL_1$, $RL_2$ and $RL_3$ are deenergized and reverse polarity, thereby forward biasing the diode $D_2$ which in turn clips the counter EMF spike.

Figure 4A:
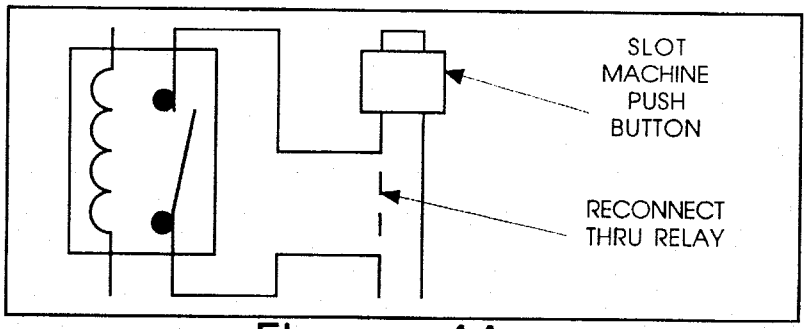
FIG. 4A is a perspective detail of FIG. 4.

Connected to each of the three relay switches $S_1$, $S_2$ and $S_3$ is, for example, a slot machine push button (FIG. 4A). When the enable signal is high, the relays $RL_1$, $RL_2$ and $RL_3$ close their respective switches $S_1$, $S_2$ and $S_3$, thereby allowing, for example, the push buttons 162, 164 and the coin in acceptor means 168, when pushed or activated, to close a path in which an information signal is sent to enable the slot machine 100. When the enable signal is low, the relay switches $S_1$, $S_2$ and $S_3$ remain open. Therefore, the pushing of any push button 162, 164 or the activation of the coin in acceptor means 168 is ineffective in closing the path in which an information signal is sent. As a result, the machine 100 is in a soft tilt or lockout state. Note that the soft tilt relay circuit 160 may be used to close or open paths used for sending a variety of different information signals inherent in the gaming machine 100.

Additional Hardware

In addition to the main system 10 components, certain other hardware is preferred to provide the most reliable system possible. The following is a description of these components:

Uninterruptable Power Supply

Referring to FIG. 1, the file server/polling computer 30 at the host site 20 will operate on an uninterruptable power supply 38 to provide clean, continuous power. In the event of a prolonged loss of electrical power to the file server/polling computer 30, a series of shutdown procedures will be followed.

Surveillance Equipment

In accordance with the Internal Controls and Procedures, certain video cameras and taping equipment 280 will be installed for continual surveillance of each of the attached slot machines 100 at each casino site 80.

Maintenance System

Figures 5, 5A:
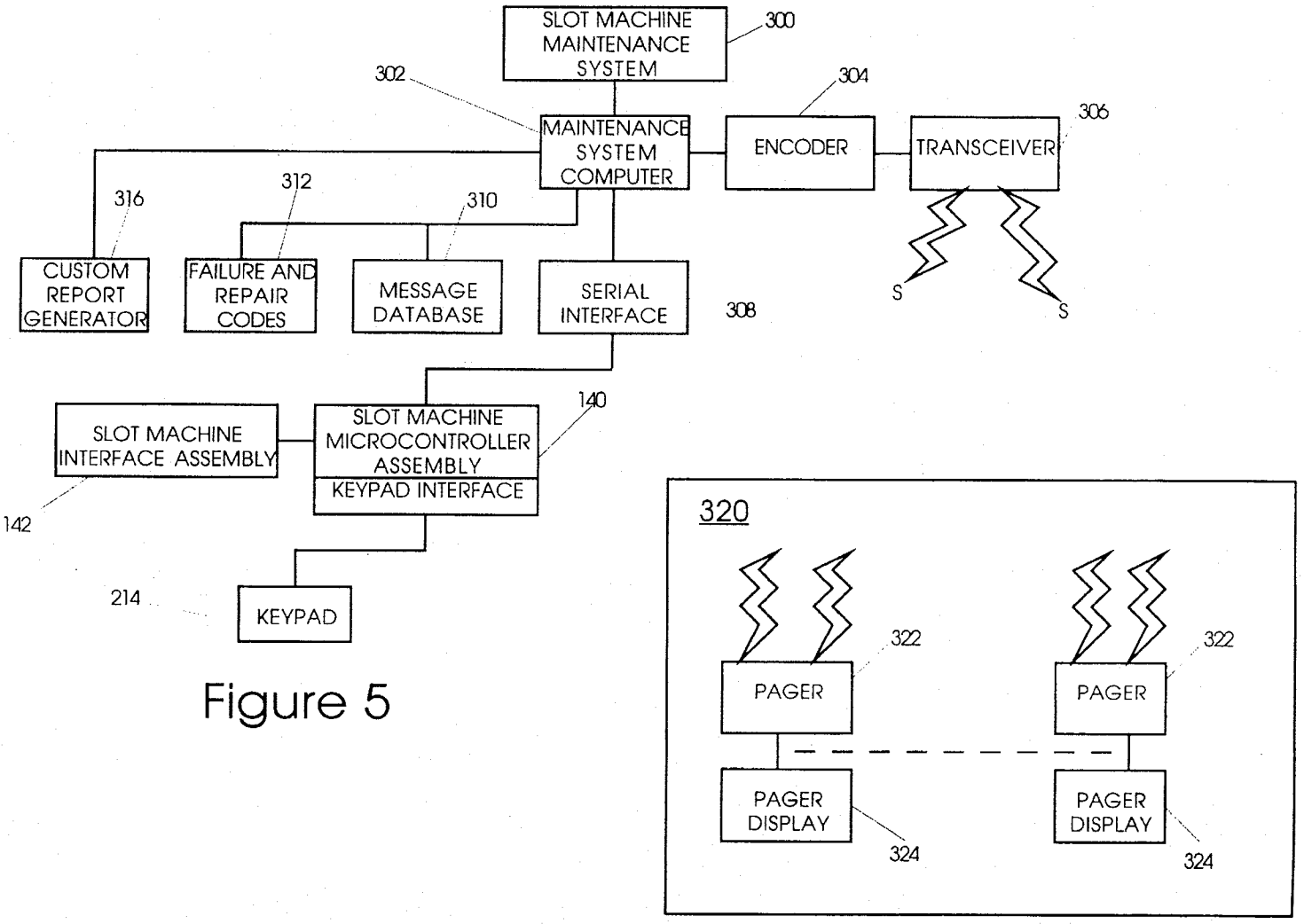
FIG. 5 is a block diagram of a maintenance system of the progressive gaming system tailored for use in multiple remote sites.

Referring to FIG. 5, slot machine maintenance can be accomplished by a slot machine maintenance system 300 including a maintenance system computer 302 having at least one serial interface 308 and associated software designed to monitor maintenance problems and repairs of a plurality of slot machines 100. The maintenance system 300 is designed to assist slot technicians T in maintaining and tracking the performance of the slot machines 100 monitored by the slot machine microcontroller assembly 140. Problem and repair messages are the key to enabling the maintenance system capabilities. As problems arise on the casino floor, they may quickly be entered into the system through the keypad 214 located at each gaming machine 100. Problem messages may also be automatically generated through a serial interface 308 interfaced with each slot machine microcontroller assembly 140 of each gaming machine 100. Messages are monitored via the maintenance system 300 which can automatically notify technicians "T" of the need for service on a specific machine 100. After the problem is repaired, the technician will then enter the appropriate code into the keypad 214 to clear the outstanding repair request.

Response time analysis between real time problem identification and repair activity allows casino management the ability to review labor allocations on the casino floor, especially during peak time. The slot machine microcontroller assembly 140 can be used in conjunction with the keypad 214 for real time data entry at the slot machine 100.

A standard message database 310, along with failure and repair codes 312, is included in the slot machine maintenance system 300, thereby providing a strong foundation for the maintenance system 300. In addition, user defined messages may be easily created and added to the message data base 310. This feature allows the product to be customized into many different environments. As the maintenance system 300 problem and repair database continue to grow, so will the available information on the overall performance of the casino floor. The maintenance system 300 may also include a custom report generator 316 to allow management to evaluate problems easily.

A paging system 320 may also be incorporated into the maintenance system 300 for providing improved communications on the casino floor. Pagers 322 may be assigned to employees (technicians "T") based on zones within the casino. As technicians "T" come onto a shift, they can indicate to the maintenance system 300 which group of machines 100 they are assigned to monitor. As maintenance messages are received by the maintenance system 300, they can be relayed immediately to the pager 322 assigned to the specific zone containing the machine requiring service. Note that real time jackpot and fill notifications for floor employees may also be provided through the maintenance system 300.

The maintenance system computer 302 runs an application software interface program which in turn works with a paging encoder device 304. The paging encoder device 304 includes a built-in synthesized radio frequency transceiver 306 which can function as both a transmitter and receiver of radio signals "S". The transceiver 306 can provide local area coverage for radio paging or two-way communications. Typically, the paging encoder device is capable of sending pages to up to 1000 (one thousand) pagers, depending on the specific model. The paging messages in the form of radio signals "S" are received and decoded by the pager 322 and can be displayed to the technician "T" via the pager display 324. Pager messages include, but are not limited to, the following: hot player identification; security messages, such as illegal door access; maintenance messages, such as tilt codes; jackpot and fill messages; and personalized and broadcast messages.

Software Summary

The software system is broken down into the following categories: operating system software, network software, polling software, accounting software, casino site computer systems software, bank controller software, and slot machine microcontroller software.

Operating Systems

All 80×86 based computers (the host site and casino site equipment) will run under the DOS operating system.

Network Software

The file server/polling computer 30 and accounting workstation computer 50 is preferably interconnected via LANtastic's NetBIOS 4.1 network system software. This software, which is preferably configured on the file server/polling computer 30, will prevent unauthorized access to various files and directories. It may also provide read only access to certain files.

Polling Software

The file server/polling computer 30 has the following primary responsibilities: to maintain constant and secure communications with each casino site; poll and upload each casino site's data and reconcile it with the overall wide area data; to compute the progressive amounts and contribution rates and broadcast out or download updated meters system wide; to process all jackpots; provide the highest level of system security and data assurance; and to log all system audit events to disk 48 and to the attached printer 32.

Accounting Software

The accounting workstation computer 50 will accommodate all reporting and machine inquiries for the system 10 with the exception of the real-time audit logs produced by the file server/polling computer 30 and casino site master controller 82. All daily accounting reports will include details on individual casino sites 80 in addition to system-wide totals.

Casino Site Software

The casino site program's primary responsibilities are: to maintain continuous communications with the file server/polling computer 30 at the host site 20; to maintain continuous communications with each attached bank controller 120; to store all bank controller data internally; report this data to the master controller 82; to reconcile all bank data at the casino site 80 for communications to the file server/polling computer 30; to broadcast new jackpot amounts to the bank controllers 120 and to the progressive meter displays 104; to log any casino site-specific exceptions internally and on the attached printer 84.

Bank Controller Software

This program's primary responsibilities are: to maintain continuous communications with the casino site master controller 82; to poll and reconcile all data from the slot machine microcontroller assembly 140; to store slot machine microcontroller data internally; and to log any bank specific exceptions internally and broadcast to the casino site master controller 82.

Slot Machine Microcontroller Software

This program's primary responsibilities are: to continuously monitor the slot machine 100 and log all coins in, coins out, slot door accesses, logic door accesses, security enclosure accesses, jackpots, power resets, and communications failures; to report all slot machine 100 activity to the bank controller 120; to prevent operation of the slot machine 100 in certain critical error conditions, most notably is a loss of communications for a prolonged period of time or a monitored tampering of any security control point.

In use and operation, and referring to the drawing, as any player P at any participating individual casino site 80 plays a slot machine 100 the activity is collected by the slot machine microcontroller assembly 140 and reported to its respective bank controller 120. Each casino site master controller 82 polls the data, reflecting the activity of each slot machine, from the bank controllers 120. This data is stored in each casino site master controller 82 until it is polled by the host computer 30 at the host site 20. The host computer 30 calculates the jackpot contribution amount from each casino site on a machine-by-machine basis and then broadcasts or downloads the updated progressive jackpot amount to each of the casino site master controllers. The progressive jackpot amount is continuously updated and displayed on the progressive meter display 104.

When a designated winning combination on a slot machine 100 is hit by a player P, that machine 100 immediately locks up and cannot be played. When the winning sloe machine 100 is polled by the bank controller 120, the machine 100 reports that it has hit the progressive jackpot. This information is then sent to the casino site master controller 82 where it is uploaded to the host computer 30 over a bi-directional communication link (telephone line) 44. When the host computer 30 receives the progressive win information, it notifies the system operator of the progressive win. It also writes this information on cartridge 48 and sends it to the printer 32.

The winning casino site master controller 82 copies a reset progressive amount to the "current" progressive amount and broadcasts this new progressive amount to all bank controllers 120 and displays 104. The host computer 30 will upload this new progressive amount from the winning casino site master controller 82 and broadcasts it back to all casino site master controllers except to the winning casino site in which the data originated. All casino site master controllers will pass this new progressive amount on to the bank controllers 120 and displays 104. Once the progressive jackpot win is validated, payment will be made directly to all jackpot winners.

This arrangement allows a progressive gaming system 10 having a large number of slot machines 100 at individual remote casino sites 80 to contribute to and compete for the same progressive jackpot.

The progressive gaming system 10 can be configured to allow casino operators the advantage of offering their players the irresistible appeal of winning, for example, a $1,000,000.00 (one million dollar) jackpot instantly. A predetermined assignee, such as the operator of the host site 20, will be responsible for the payout of the $1,000,000.00 (one million dollar) jackpot so that the individual participating casino sites never have to worry about keeping on-site cash reserves. In addition, the assignee may also provide all necessary accounting and reporting with respect to the winning of the jackpot.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A progressive gaming system comprising in combination:

a host site including a host computer;

a plurality of remote gaming sites each including a plurality of gaming machines;

means for acquiring gaming machine generated signals including a funds-in signal from each said gaming machine at each said remote gaming site;

said acquiring means includes a plurality of microcontroller assemblies, and includes a plurality of interface assemblies and means for coupling at least one said interface assembly to at least one said gaming machine;

wherein said means for coupling said interface assembly to said gaming machine includes a soft lockout circuit; and means for exchanging data including said gaming machine generated signals between said acquiring means and said host computer whereby said plurality of gaming machines at each said remote gaming site contribute to and compete for at least one progressive jackpot.

2. The system of claim 1 wherein each said interface assembly includes means for providing a listen-only interface between each said microcontroller assembly and each said gaming machine for acquiring said machine generated signals.

3. The system of claim 2 wherein said data exchanging means includes at least one master controller at each of said remote gaming sites.

4. The system of claim 3 wherein said data exchanging means further includes at least one bank controller at each said remote gaming site for polling data from a plurality of said microcontroller assemblies interfaced with said gaming machines.

5. The system of claim 4 wherein at least one said bank controller reports said gaming machine generated signals to said master controller at each said remote gaming site.

6. The system of claim 5 including means for bi-directionally communicating data between said host computer at said host site and said master controller at each of said plurality of remote gaming sites.

7. The system of claim 6 including means for processing by said host computer said gaming machine generated signals from each of said master controllers for computing contribution rates and a progressive jackpot amount.

8. The system of claim 7 including means for communicating said progressive jackpot amount from said host computer to each said master controller by way of said bi-directional communicating means.

9. The system of claim 8 including means for displaying said progressive amount on at least one progressive meter display at each said remote gaming site.

10. The system of claim 1 including means for providing said plurality of gaming machines at each said remote gaming site the ability to compete for an instant jackpot of one million dollars.

11. The system of claim 1 wherein each said microcontroller assembly includes means for controlling said soft lockout circuit for placing each said gaming machine in a soft lockout condition whereby the gaming machine is disabled from further play.

12. The system of claim 11 wherein each said gaming machine is able to cashout any credits that are on its credit meter when said gaming machine is in said soft lockout condition.

13. The system of claim 1 wherein said host site further includes an accounting computer and a network operatively networking said accounting computer with said host computer, said accounting computer produces accounting, auditing and maintenance reports.

14. The system of claim 13 wherein said host site further includes a printer operatively coupled to said accounting computer for printing said reports.

15. The system of claim 14 wherein said host site further includes an uninterruptable power supply operatively coupled to said host computer for providing continuous power.

16. The system of claim 15 wherein said host site further includes a backup computer which replaces said host computer in the event of a system failure.

17. The system of claim 16 wherein said host site further includes a surveillance computer with a visual display of real time transaction at said host site, said surveillance computer is allowed real time access to data without required access to said host computer.

18. The system of claim 17 wherein said host site further includes a second printer operatively coupled to said host site computer for providing a real-time audit log of all systems events.

19. The system of claim 18 wherein said host site computer includes a removable memory means for storing all transactional data from said plurality of gaming sites.

20. A progressive gaming system comprising in combination:

a host site including a host computer;

a plurality of remote gaming sites each including a plurality of gaming machines;

means for acquiring gaming machine generated signals including a funds-in signal from each said gaming machine at each said remote gaming site;

means for exchanging data including said gaming machine generated signals between said acquiring means and said host computer whereby said plurality of gaming machines at each said remote gaming site contribute to and compete for at least one progressive jackpot;

said acquiring means includes a plurality of microcontroller assemblies;

said acquiring means further includes a plurality of interface assemblies and means for coupling at least one said interface assembly to at least one said gaming machine;

wherein each said interface assembly includes means for providing a listen-only interface between each said microcontroller assembly and each said gaming machine for acquiring said machine generated signals;

said data exchanging means includes at least one master controller at each of said remote gaming sites;

wherein said data exchanging means further includes at least one bank controller at each said remote gaming site for polling data from a plurality of said microcontroller assemblies interfaced with said gaming machines;

wherein at least one said bank controller reports said gaming machine generated signals to said master controller at each said remote gaming site;

including means for bi-directionally communicating data between said host computer at said host site and said master controller at each of said plurality of remote gaming sites;

including means for processing by said host computer said gaming machine generated signals from each of said master controller for computing contribution rates and a progressive jackpot amount;

including means for communicating said progressive jackpot amount from said host computer to each said master controller by way of said bi-directional communicating means;

including means for displaying said progressive amount on at least one progressive meter display at each said remote gaming site;

including means for providing said plurality of gaming machines at each said remote gaming site the ability to compete for an instant jackpot of one million dollars; and wherein said means for coupling said interface assembly to said gaming machine includes a soft lockout circuit.

21. A progressive gaming system comprising in combination:

a plurality of gaming devices;

a soft lockout means operatively coupled to at least one said gaming device for placing said gaming device in a soft lockout condition wherein said gaming device is disabled from further play;

means for monitoring maintenance signals of said gaming devices;

means for receiving said maintenance signals from said monitoring means;

at least one portable pager;

said pager carried by a human;

wireless communication means for relaying a message signal correlative of said maintenance signals from said receiving means to at least one said portable pager.

22. The system of claim 21 wherein said monitoring means includes a microcontroller assembly interfaced with each said gaming machine for monitoring maintenance signals therefrom and operatively coupled to said soft lockout means for controlling said soft lockout means for placing at least one said gaming device in a soft lockout condition.

23. The system of claim 22 wherein said receiving means includes a computer interfaced with each said microcontroller assembly for receiving said maintenance signals therefrom.

24. The system of claim 23 wherein said wireless communication means includes an encoder device interfaced with said computer.

25. The system of claim 24 wherein said encoder device includes a transceiver for relaying said message signal correlative of said maintenance signals to said pager.

26. A method for providing a progressive gaming system, comprising the steps of:

providing a host computer at a host site;

providing at least two remote gaming sites;

providing a plurality of gaming machines at each remote gaming site;

providing at least one bank controller at each of the remote gaming sites;

interfacing a microcontroller assembly to each gaming machine at each remote site;

providing a soft lockout circuit;

coupling the soft lockout circuit to each gaming machine via the microcontroller assembly;

controlling the soft lockout circuit with the respective microcontroller assembly for placing the gaming machine in a soft lockout condition wherein play is suspended;

connecting a plurality of the microcontroller assemblies to at least one bank controller;

acquisitioning gaming machine generated data including maintenance data from each gaming machine on its activity by the microcontroller assembly;

reporting the acquisitioned gaming machine generated data from each microcontroller assembly to each respective bank controller;

providing a master controller at each remote gaming site;

reporting bank controller data including gaming machine generated data from each bank controller at each remote gaming site to each respective master controller;

reporting master controller data including bank controller data and gaming machine generated data from each master controller at each remote gaming site to the host computer at the host site;

processing by the host computer the bank controller and the master controller data for computing contribution rates and a progressive jackpot amount;

communicating the progressive jackpot amount from the host computer to each master controller.

27. The method of claim 26 further including the step of displaying the progressive jackpot amount on at least one progressive meter display at each remote gaming site.

28. The method of claim 27 wherein the step of reporting the acquisitioned data from each microcontroller unit to each respective bank controller includes the step of storing the data in a memory means of said bank controller.

29. The method of claim 28, wherein the step of reporting the data from each bank controller at each remote gaming site to each respective master controller includes the step of storing said data from each bank controller at each remote gaming site in a memory means of each respective master controller.

30. A method for providing a progressive gaming system, comprising the steps of:

providing a host computer at a host site;

providing at least two remote gaming sites;

providing a plurality of gaming machines at each remote gaming site;

providing at least one bank controller at each of the remote gaming sites;

interfacing a microcontroller assembly to each gaming machine at each remote site;

connecting a plurality of the microcontroller assemblies to at least one bank controller;

acquisitioning gaming machine generated data including maintenance data from each gaming machine on its activity by the microcontroller assembly;

reporting the acquisitioned gaming machine generated data from each microcontroller assembly to each respective bank controller;

providing a master controller at each remote gaming site;

reporting bank controller data including gaming machine generated data from each bank controller at each remote gaming site to each respective master controller;

reporting master controller data including bank controller data and gaming machine generated data from each master controller at each remote gaming site to the host computer at the host site;

processing by the host computer the bank controller and master controller data for computing contribution rates and a progressive jackpot amount;

communicating the progressive jackpot amount from the host computer to each master controller;

displaying the progressive jackpot amount on at least one progressive meter display at each remote gaming site;

wherein the step of reporting the acquisitioned data from each microcontroller unit to each respective bank controller includes the step of storing the data in a memory means of said bank controller;

wherein the step of reporting the data from each bank controller at each remote gaming site to each respective master controller includes the step of storing said data from each bank controller at each remote gaming site in a memory means of each respective master controller; and wherein the step of interfacing a microcontroller assembly to each gaming machine at each remote gaming site further includes the step of providing a soft lockout circuit.

31. The method of claim 30 including the step of controlling the soft lockout circuit with the respective microcontroller assembly for placing the gaming machine in a soft lockout condition whereby all play is suspended.

* * * * *

Disclaimer 5,611,730—Steven A. Weiss, Las Vegas, Nev. PROGRESSIVE GAMING SYSTEM TAILORED FOR USE IN MULTIPLE REMOTE SITES: APPARATUS AND METHOD. Patent dated March 18, 1997. Disclaimer filed March 7, 2001, by the assignee, Casino Data Systems.

Hereby enters this disclaimer to claims 1-31 of said patent.

*(Official Gazette, July 31, 2001)*